United States Patent [19]

Tolson

[11] Patent Number: 4,676,006

[45] Date of Patent: Jun. 30, 1987

[54] POULTRY BASKET WATER REMOVAL APPARATUS AND METHOD

[75] Inventor: Sydney S. Tolson, Scotland Neck, N.C.

[73] Assignee: Ossid Corporation, Scotland Neck, N.C.

[21] Appl. No.: 916,390

[22] Filed: Oct. 7, 1986

[51] Int. Cl.[4] ..... F26B 5/00

[52] U.S. Cl. ..... 34/22; 34/34; 34/233; 34/217; 15/306 B; 15/316 R; 15/345

[58] Field of Search ..... 15/306 B, 345, 306 R, 15/316; 34/225, 233, 217, 22, 34

[56] References Cited

U.S. PATENT DOCUMENTS 2,746,935 5/1956 Weisz ..... 252/448

4,173,830 11/1979 Hanson ..... 34/15

4,251,895 2/1981 Caridis et al. ..... 15/345

4,420,854 12/1983 Newton ..... 15/306 B

*Primary Examiner*—Larry I. Schwartz

*Attorney, Agent, or Firm*—B. B. Olive

[57] ABSTRACT

A method and apparatus for removing water from a package loaded open top basket having a bottom wall, end and side walls with numerous ribs, crevices and openings conducive to collecting water are based on using spaced apart pressurized air and vacuum sources operated so as to sequentially accumulate and move the water downwardly and to a location near a suction source on one side of the basket, then to a location near a suction source on the opposite side of the basket and finally by applying suction to the bottom of the basket.

8 Claims, 7 Drawing Figures

POULTRY BASKET WATER REMOVAL APPARATUS AND METHOD

DESCRIPTION

1. Technical Field

The invention relates to apparatus and methods for removing water from the surfaces of conveyor-transported, open-top, package-loaded baskets of the type having a substantial number of openings, crevices, ribs and surfaces in the bottom, end, and side walls and particularly applies to poultry processing.

2. Background Art

Poultry is typically packaged by placing the whole or cut poultry on some form of disposable plate and covering the poultry with a transparent film. One type of film employed for this purpose is the so-called "PVC" (polyvinyl chloride) stretch film. When the PVC stretch film is employed, it is normally wrapped over the poultry, heat sealed to the package and then the package is sent directly to the cooling room. A more recent development involves the use of a clear anti-fog polyolefin stretch shrink type film such as made by the Cryovac Division of W. R. Grace & Company and sold under the trade designation SSD-310 and SSD-350. When the stretch shrink film is employed, the film is wrapped around the poultry, sealed to the package and is then passed through a hot water bath which shrinks the film and effectively forms a shrink wrap poultry package. It has been shown that the shrink wrap system produces a package which is more impervious to air than is the PVC type film and also has a less abrasive action on the poultry product.

The poultry packages having a shrink-type wrap are conveyed through the hot water bath which shrinks the film while being carried in plastic-molded baskets, sometimes also referred to in the trade as a crate or rack. Such baskets typically have a perforated or mesh-type bottom and numerous openings, ribs, crevices and water-collecting surfaces in the sides and ends of the basket. Thus, when the package is subjected to a hot water bath for the purpose of shrinking the film, substantial water is left on the basket. Also, when two layers of packages are carried in the same basket, the upper layer of packages is supported on a removable perforated shelf and this shelf tends to collect substantial water. Since it is necessary to cool the poultry immediately after the hot water bath, it is desirable to remove as much of the water as possible from the baskets so as to reduce the cooling load.

One approach for removing the water stored on the surfaces, on the shelves, and in the crevices of the baskets has been to bump the basket and to apply high velocity air blasts from both sides of the basket and from above the basket in an attempt to force the water off the basket. However, in most instances the water simply tends to cling to the particular surface or crevice where stored and is not removed. Such apparatus has not proven practical.

While not related to removing water from baskets of the type used in poultry processing, U.S. Pat. No. 4,173,830 illustrates apparatus forcing pressurized air through a mesh-type baking tray for the purpose of removing moisture from the tray. However, the system taught by U.S. Pat. No. 4,173,830 is not satisfactory for the purpose of removing water from loaded poultry baskets because of the substantial difference in the structure of the poultry basket as compared to the structure of the bakery tray described in U.S. Pat. No. 4,173,830. Further, it is highly undesirable in poultry processing to recirculate the water-laden air as takes place in the process described in U.S. Pat. No. 4,173,830. U.S. Pat. No. 2,746,935 is also noted as teaching a sequence of directly-opposed, pressure-vacuum stations for the purpose of drying wet articles on a moving conveyor but not deemed suitable for poultry processing.

With the described prior art in mind, there has developed a need for providing an apparatus and method particularly suited to removing the maximum amount of water from baskets carrying packages of poultry immediately after having had the film shrunk by a hot water spray.

DISCLOSURE OF INVENTION

The method and apparatus of the invention relates to removing water stored on the surfaces, on the shelf, if any, and in the crevices of baskets used for transporting shrink film-wrapped poultry packages after hot water has been applied to shrink the film. According to the invention, the water captured in the surfaces, on the shelf, and in the crevices is first forced to move downwardly by means of a high velocity air blast spanning the width of the baskets as they move on an open conveyor. Following the crosswise downward air blast another air blast is applied to the front side of the basket to force the water towards the back side and so as to collect as a mass and move towards the bottom of the basket. The side air nozzle is located and shaped such that when a shelf is employed, the mentioned sidewise air blast tends to move water on the bottom of the shelf towards the opposite side for more accessible removal by vacuum. As the basket continues to move on the open conveyor to another position, the back side of the basket passes a suction slot which generally spans the height of the basket and tends to pull and remove a certain amount of the previously downwardly forced accumulated masses of water from the surfaces, from the shelf when used, and crevices of the basket. As the basket continues to move further on, another air blast is applied to the back side of the basket to force water toward the front side of the basket and so as to collect as a mass and move towards the bottom of the basket. Next, as the basket continues to be conveyed it next passes another vacuum slot which contacts the front side of the basket and removes another portion of the previously downwardly forced accumulated masses of water. Finally, the basket is conveyed over a crosswise extending vacuum slot which removes additional accumulated masses of water adjacent the bottom of the basket following which the basket is positively engaged by a short second conveyor and moved away from the invention apparatus to a conventional conveyor for transport to the cooling area. In one embodiment, each basket is tilted slightly when moving from the conventional conveyor onto the invention conveyor so as to cause at least some of the accumulated water to accumulate in masses and move towards one end and nearer to the bottom of the basket. In another embodiment the basket enters the invention conveyor at the same level as it leaves the conventional conveyor following the hot water bath.

BEST MODE FOR CARRYING OUT THE INVENTION

As background for the more detailed description to follow, further brief reference will be made to the method of packaging poultry which gives rise to the invention. In particular, after poultry has been properly prepared and either cut or placed as a whole on a disposable tray the poultry and tray are wrapped with a shrink wrap film and such film is heat sealed to form the package. In order to shrink the film around the poultry product, it is necessary to heat the film in a manner which does not either degrade the poultry or the film. The conventional method for shrinking the film calls for the poultry packages to be placed in poultry baskets which are then conveyed through a hot water bath which causes the film to shrink and thus form individual shrink wrapped packages of poultry. The typical basket used for this purpose, a molded plastic basket is formed with a perforated bottom surface and is made up of a series of interconnected ribs on the sides and ends of the basket thus providing numerous surfaces and crevices which tend to collect the water. Also when poultry packages are disposed in two layers, the upper layer is placed on a removable perforate shelf which resides within the basket above the first layer. The shelf is made up of interconnected ribs and because of its perforate form also tends to collect substantial amounts of water. Baskets and shelves of this type molded of high density polyethelene are made and sold by Buckhorn, Inc., of Cincinnati, Ohio, under Model Numbers 18-4-50E, 18-4-51 and 18-4-55E which vary as to size, use of shelves, vertical dividers, and the like. Thus, it becomes necessary to remove as much of this water as possible before the poultry is cooled prior to being shipped from the poultry processing plant. The present invention is thus primarily directed at a practical apparatus and method for removing the maximum amount of water left on the baskets so as to minimize the cooling load and to eliminate the risk of forming ice and other frozen surfaces in the cooling chambers.

Figure 1:
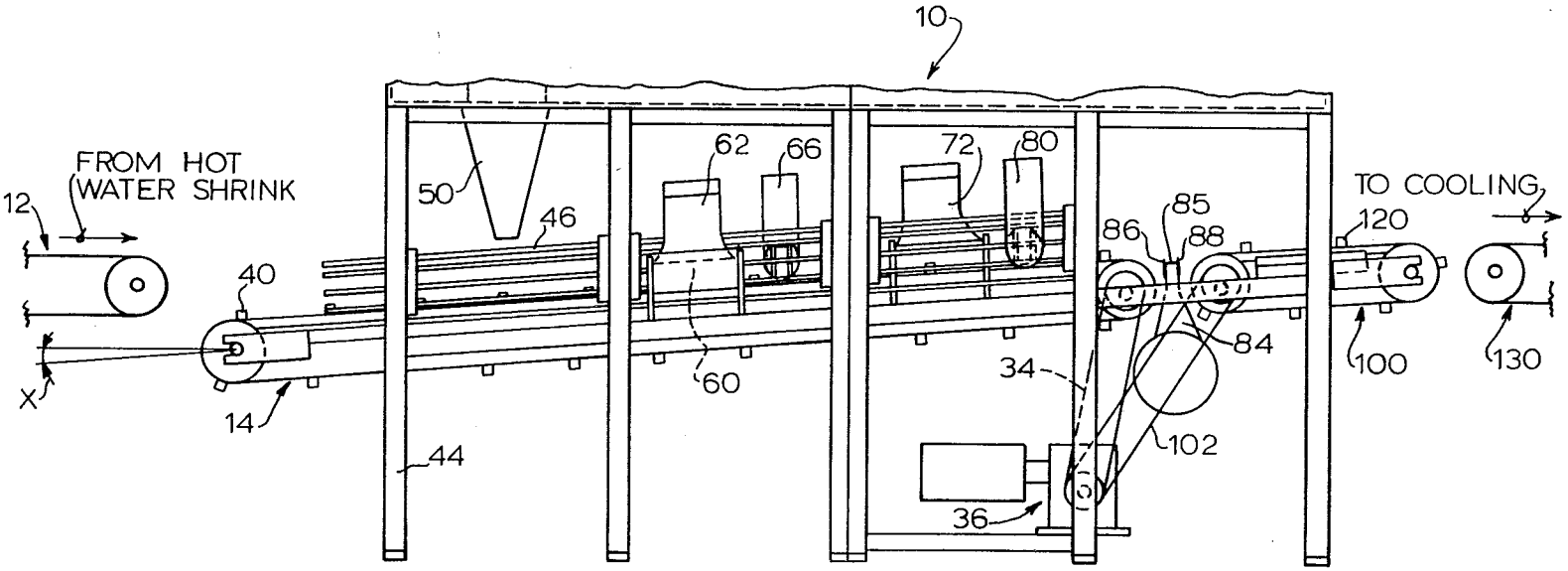
FIG. 1 is an elevation view of an apparatus for removing water from poultry baskets according to the invention but with elimination of the baskets themselves for purposes of illustration.
Figure 2:
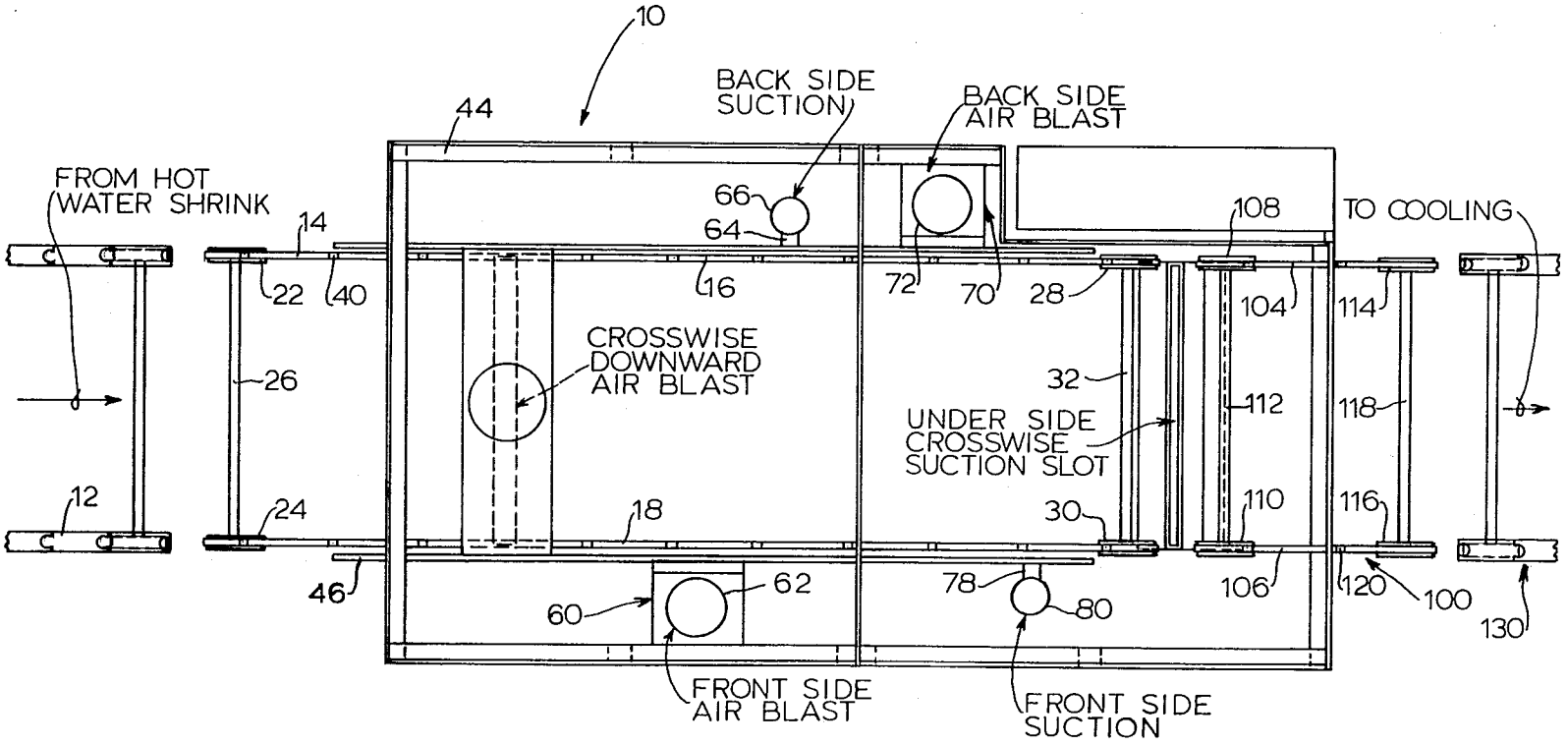
FIG. 2 is a plan view of the apparatus of FIG. 1 but with the baskets eliminated for purposes of illustration.
Figure 6:
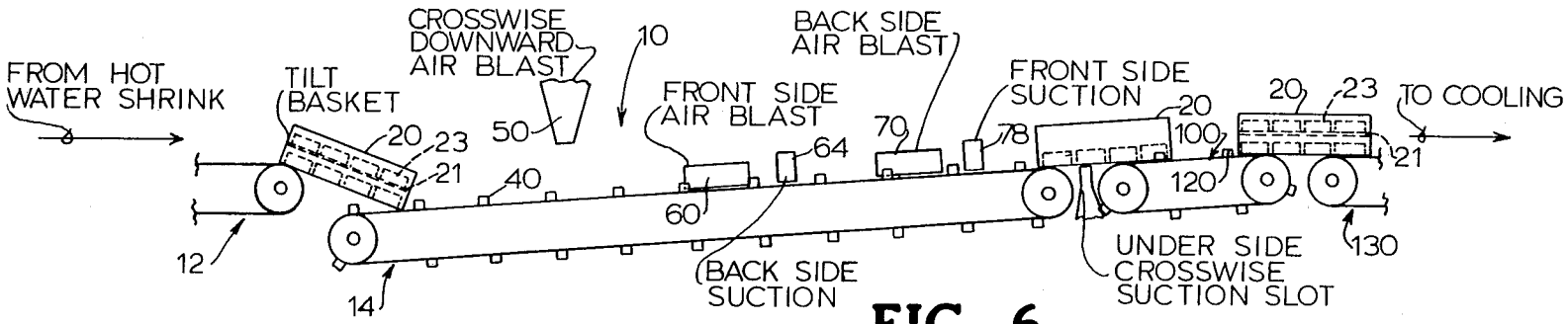
FIG. 6 is a schematic drawing illustrating the drying method associated with the apparatus of FIG. 1.
Figure 7:
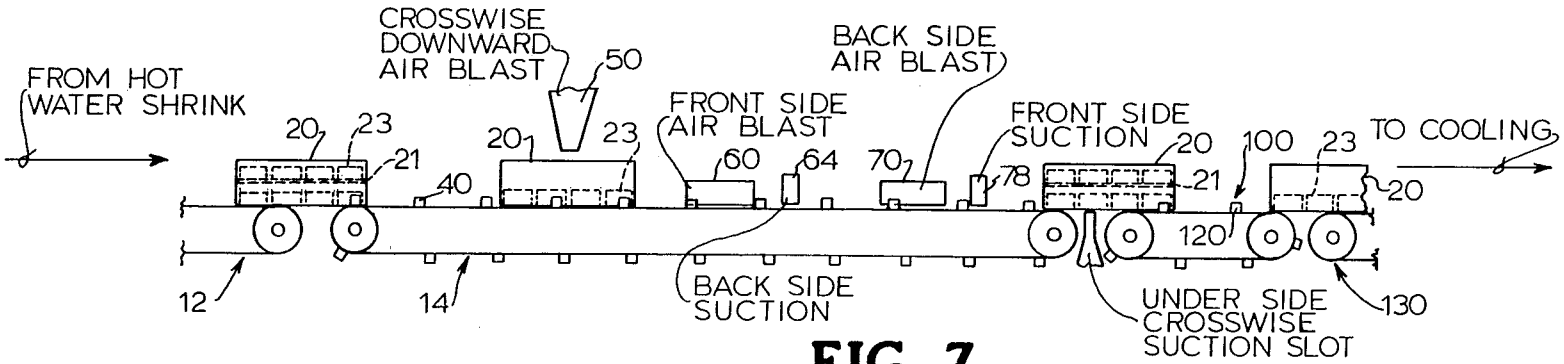
FIG. 7 is a schematic diagram illustrating the drying method associated with the apparatus of FIG. 2.

Making reference initially to FIG. 1 there is illustrated a water removal apparatus 10 according to a first embodiment of the invention. The baskets 20 later referred to in reference to FIGS. 6 and 7 are eliminated in FIGS. 1-3 to better illustrate the apparatus. Making reference initially to FIGS. 1 and 2, a conventional conveyor 12 brings the baskets of poultry directly from the hot water bath where the film wrap is shrunk to the apparatus 10 of the invention. In some instances the baskets 20 will have a removable perforate shelf 21 for holding an upper layer 23 of shrink wrapped poultry packages and in other instances as for example when the packages contain only large whole poultry the shelf 21 is not employed. When a shelf is employed however the shelf itself tends to accumulate substantial water which needs to be removed. Apparatus 10 comprises an open chain type conveyor 14 made up of a pair of conveyor chains 16,18 supported at one end by sprockets 22,24 on shaft 26 and at the opposite end by sprockets 28,30 on shaft 32 driven through belt 34 by motor drive 36. Each of the conveyor chains 16,18 are equipped with lengthwise spaced upstanding lugs 40 the purpose of which is to positively and loosely engage each successive basket on conveyor 14 to ensure the baskets positive movement throughout the apparatus 10 of the invention.

A suitable frame 44 supports the described conveyor 14 and basket guide rails 46. It will be noted particularly in reference to FIGS. 1 and 6 that the incoming conveyor 12 is at a higher elevation than is the entry end of conveyor 14 forming part of the apparatus 10 of the invention. Thus, the basket 20 is tilted downwardly (FIG. 6) as it enters the apparatus 10 of the invention. Such tilting has been found to assist in moving the collected hot water towards the leading end and towards the bottom of the basket 20 such that the water tends to collect in more easily removed masses as near as possible to the bottom of the basket. Also to be noticed is that conveyor 14 is at a slight incline to the horizontal indicated by the angle X in FIG. 1 and which may, for example, be approximately 10 to 15 degrees. As the baskets move on the conveyor 14 they are first subjected to an extremely high velocity blast from above the baskets and which exists through a narrow rectangular opening formed in a tapered duct 50 which extends above and crosswise of conveyor 14. Thus, the baskets 20 loaded with the poultry packages are first subjected across the entire width of the basket 20 to this high velocity air blast. Such air blast tends to move at least a portion of the collected water towards the bottom of the basket and to collect in masses more accessible for later suction removal. Duct 50 is connected to a suitable source of pressurized ambient air and discharges onto the basket 20 and would then typically discharge into the room in which the apparatus 10 is located. As the basket 20 moves up the inclined conveyor 14, the front side of the basket is next blasted from the side by another source of high velocity air which exits through a substantially horizontally oriented rectangular opening 60 forming part of duct 62 also connected to a suitable source of pressurized high velocity air. It is particularly desirable that opening 60 be sized and located so as to force air over the bottom of any shelf being employed. As the basket 20 continues to move up the inclined conveyor 14 the back side of the basket wipes against flexible rubber blades (not shown) forming a vertically oriented rectangular opening 64 forming part of a suction duct 66. At this stage a portion of the water which is intended to be removed has been forced downwardly and caused to collect in masses near the suction opening 64 and is thus physically removed from basket 20 through the duct 66 to atmosphere.

Figure 4:
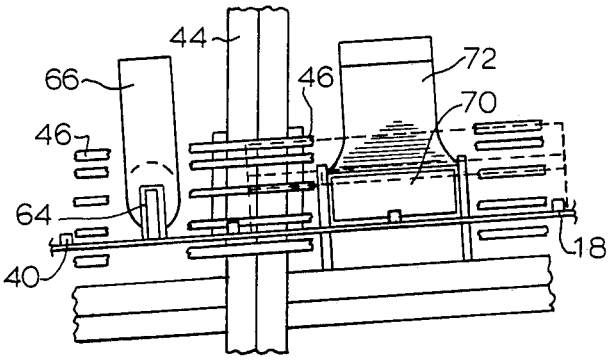
FIG. 4 is partially broken away view illustrating a typical side vacuum and side blower arrangement as embodied in the invention.

As part of a continuing sequence, basket 20 continues to move on the inclined conveyor 14 and is next exposed to a side air blast which exits through a substantially horizontally oriented opening 70 forming part of a duct 72 and connected to a suitable source of pressurized ambient air. Thus, the water remaining on the basket 20 is now forced to move towards what is being referred to as the front side of the basket. Also, both under influence of gravity and the previously applied air blasts the water has tended to be collected in masses and moved towards the bottom of the basket 20. As basket 20 continues to move up on inclined conveyor 14, it next passes and wipes against flexible rubber blades (not shown) forming another vertically oriented suction opening 78 forming part of a vacuum or suction duct 80 of a construction similar to the previously explained duct 66 as best illustrated in FIG. 4. Thus, water which has been forced towards the front side of the basket and also caused to collect in masses near the bottom of the basket 20 by the last side air blast exiting opening 70 of duct 72 is removed through the suction duct 80.

Figure 5:
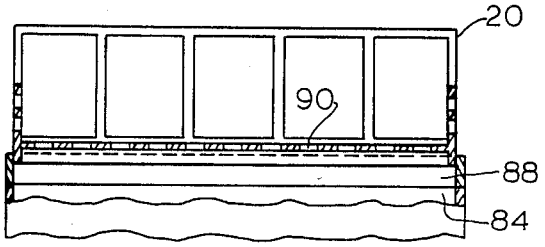
FIG. 5 is a cross section taken through the width of a typical basket illustrating how the perforated bottom is recessed.

As the basket 20 continues to move it next passes over and wipes against a crosswise extending vacuum or suction duct 84 which terminates in a narrow crosswise extending rectangular opening 85 having on its boundaries a pair of flexible rubber blades 86,88 similar to those on suction openings 64 and 78 and which assist in transferring the suction effect directly against the bottommost surfaces of the perforated bottom 90 of the basket 20 as best illustrated in FIG. 5 where by this stage much of the water will have accumulated in more easily removed masses. After leaving conveyor 14, each basket 20 loosely engages and is next transferred to a short conveyor 100 driven through belt 102. Conveyor 100 comprises a pair of conveyor chains 104,106 mounted at one end on sprockets 108,110 on drive shaft 112 and at the opposite end on sprockets 114,116 on shaft 118. Conveyor 100 is at the same incline as conveyor 14 and is also equipped with lugs 120 similar to the previously mentioned lugs 40. Conveyor 100 thus provides the means for loosely engaging and positively pulling each basket 20 over the vacuum slot 85 provided by vacuum duct 84. After leaving the conveyor 100 each basket 20 is transferred to another conventional conveyor 130 from which the baskets 20 are then suitably transferred to the cooling chambers.

Figure 3:
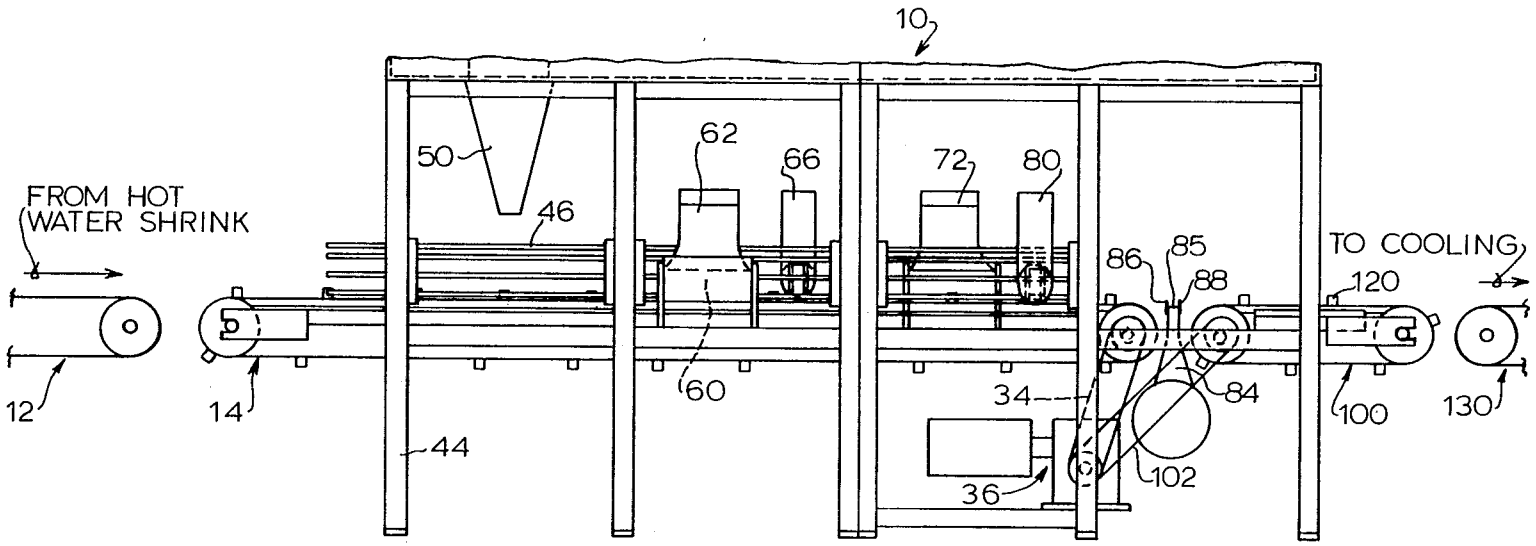
FIG. 3 is a side elevation of an apparatus similar to FIG. 1 but showing an alternative embodiment of the invention.

In a second embodiment illustrated in FIGS. 3 and 7 a substantially identical construction is followed except that the incoming conveyor 12 is at the same elevation as the conveyor 14 of the invention and conveyor 14 is not inclined as in FIGS. 1 and 6. Thus, while the advantage of the tilting action depicted in FIGS. 1 and 6 is not obtained, it has nevertheless been found that the apparatus of FIGS. 3 and 7 operates to remove a sufficient amount of water to meet commercial requirements.

In summary, it will be noticed that the method and apparatus of the invention provides a unique system in which a crosswise air blast operates on the top of the baskets initially, a crosswise suction operates on the bottom of the baskets as a final water removal operation and between such crosswise air blast and crosswise suction the collected water is operated on by a succession of offset pressure-vacuum nozzles. The overall net effect is thus to sequentially move the water to one side of the basket and towards the bottom of the basket for collection in discrete masses and thereafter remove the water by suction followed by other blowing and suction and water mass accumulation operations of a similar nature.

The exact volume and velocity of air forced through the pressure and suction nozzles will vary with the type baskets being processed, the speed of the conveyor and like conditions. However, in all instances the air flow must be substantial and enough for moving and removing the water as described. In one embodiment duct 50 carried approximately 13,000 c.f.m. and ducts 62 and 72 carried approximately 600 c.f.m. The vacuum ducts were operated at approximately 18 inches negative water pressure.

What is claimed is:

1. A method for removing water collected on the surfaces and in the crevices of a package loaded open top crate having a perforated bottom wall and end and side walls, said walls each being perforate and having numerous ribs, crevices and openings conducive to collecting and holding water discharged on said basket and its load while said basket is being transported on and loosely engaged with an endless open driven conveyor comprising;

(a) at a first station proximate the trailing end of the conveyor directing a substantial volume of air at a substantial velocity from above and across the width of the basket to force water collected on packages in the basket and other water collected on the basket exposed to the flow of air to accumulate and move downwardly;

(b) at a second station located beyond said first station with respect to the direction of basket movement directing a substantial volume of air at a substantial velocity against a selected horizontally extending area of one side of the basket to force water collected on packages in said basket and on surfaces of said basket exposed to said air to move towards the opposite side and bottom of said basket;

(c) at a third station located beyond said second station with respect to the direction of basket movement establishing suction of substantial volume of air at a substantial velocity over a selected vertically extending portion of the opposite side of the basket so as to remove water collected on packages in said basket and on surfaces of said basket exposed to said suction;

(d) at a fourth station located beyond said third station in the direction of movement directing a substantial volume of air at a substantial velocity against a selected horizontally extending portion of the opposite side of the basket to force water collected on packages in the basket and on surfaces of the basket to move towards said one side and bottom of said basket;

(e) at a fifth station located beyond said fourth station and in the direction of basket movement establishing suction of a substantial volume of air at a substantial velocity over a selected vertically extending area of opposite side of the basket to remove water collected on packages in said basket and on surfaces of said basket; and (f) at a sixth station establishing suction of a substantial volume of air at a substantial velocity over a selected crosswise extending area of the basket on the bottom thereof to remove water collected on the bottom of packages in the basket and on surfaces at the bottom of said basket.

2. A method as claimed in claim 1 including tilting said basket immediately prior to conveying said basket on said conveyor.

3. A method as claimed in claim 1 wherein said conveyor is inclined.

4. A method as claimed in claim 1 including engaging and conveying said basket on a second conveyor following said sixth station to positively withdraw said basket therefrom.

5. An apparatus for removing water collected on the surfaces and in the crevices of a package-loaded, open-top basket having a bottom wall, end and side walls, said walls each being perforate and having numerous ribs, crevices and openings conducive to collecting and holding water discharged on said basket and its load, comprising;

(a) a first endless open driven conveyor having a pair of parallel belt members with means for loosely engaging and positively locating a basket being conveyed thereon and arranged for receiving incoming loaded baskets from a second conveyor;

(b) a first pressurized air source spanning the width of said conveyor with a horizontal outlet oriented to direct a substantial volume of air at a substantial velocity from above and across the width of a basket moving on said first conveyor to force water collected on packages in said basket and exposed to flow of said air and other water exposed to said air collected on said basket to accumulate and move downwardly;

(c) a second pressurized air source located adjacent to said first conveyor on one side thereof and beyond said first air source in the direction of basket movement and having an outlet located and shaped to project a substantial volume of air at a substantial velocity against a horizontally extending portion of one side of a basket moving on said first conveyor past said second source whereby to force water collected on packages in said basket and on surfaces of said basket exposed to air from said second source to move towards the opposite side and bottom of said basket;

(d) a first suction source located adjacent the opposite side of said conveyor and having an outlet located and shaped to suck a substantial volume of air at a substantial velocity past a vertically extending portion of the opposite side of a basket moving on said first conveyor past said suction source whereby to remove water collected on packages of said basket and on surfaces of said basket exposed to air being withdrawn through said first suction source;

(e) a third pressurized air source located adjacent said opposite side of said first conveyor but beyond said first suction source in the direction of basket movement and having an outlet located and shaped to project a substantial volume of air at a substantial velocity against a horizontally extending portion of said opposite side of a basket moving on said first conveyor past said third pressurized air source whereby to force water collected on packages in said basket and on surfaces of said basket exposed to air from said third source to move towards said one side and bottom of said basket;

(f) a second suction source located adjacent said one side of said conveyor but beyond said third pressurized air source in the direction of basket movement and having an outlet located and shaped to suck a substantial volume of air at a substantial velocity from a vertically extending portion of said one side of a basket moving on said first conveyor past said second suction source whereby to remove water collected on packages on said basket and on surfaces of said basket exposed to air withdrawn through said second suction source; and (g) a third suction source spanning the width of said conveyor with a horizontal outlet oriented to suck a substantial volume of air at a substantial velocity from beneath and across the width of a basket moving on said first conveyor to remove water collected on packages in said basket and exposed to the flow of said air and other water exposed to said air collected on the bottom of said basket.

6. An apparatus as claimed in claim 5 wherein said first conveyor is inclined upwardly.

7. An apparatus as claimed in claim 5 including a second endless open driven conveyor of substantially less length than said first conveyor with means for loosely engaging and positively locating a basket being conveyed thereon and arranged to receive and positively withdraw each said basket from said third suction source.

8. An apparatus as claimed in claim 6 wherein the receiving end of said first conveyor is located so as to permit the forward end of each said basket received thereon to tilt downwardly and thereby induce water collected thereon to flow forwardly and towards the bottom of said basket before being fully engaged by said first conveyor.

* * * * *

UNITED STATES PATENT AND TRADEMARK OFFICE

CERTIFICATE OF CORRECTION

PATENT NO. : 4,676,006

DATED : June 30, 1987

INVENTOR(S) : Sydney S. Tolson

It is certified that error appears in the above-identified patent and that said Letters Patent is hereby corrected as shown below:

Column 6, line 51 insert --the-- after the first appearance of "of".

Signed and Sealed this

Tenth Day of November, 1987

*Attest:*

*Attesting Officer*

DONALD J. QUIGG

*Commissioner of Patents and Trademarks*